United States Patent [19]

Bennison et al.

[11] Patent Number: 4,964,952

[45] Date of Patent: Oct. 23, 1990

[54] METHOD OF CONTROLLING PITCH USING A CATIONICALLY MODIFIED TANNIN

[75] Inventors: John J. Bennison, Runcorn; Richard P. Clifford, Great Sutton, both of England

[73] Assignee: W. R. Grace & Co.-Conn., New York, N.Y.

[21] Appl. No.: 187,628

[22] Filed: Apr. 28, 1988

[30] Foreign Application Priority Data

May 1, 1987 [GB] United Kingdom ..... 8710448

[51] Int. Cl.[5] ..... D21F 11/00; D21H 13/10

[52] U.S. Cl. ..... 162/158; 162/161; 162/163; 162/199; 162/DIG. 4

[58] Field of Search ..... 162/72, 199, DIG. 4, 162/163, 158, 87, 93, 161, 55

[56] References Cited

U.S. PATENT DOCUMENTS

| | | |
|---|---|---|
| 3,081,219 | 3/1963 | Drennen . |
| 3,154,466 | 10/1964 | Nothum . |
| 3,582,461 | 6/1971 | Lipowski . |
| 3,619,351 | 11/1971 | Kolosh . |
| 3,632,507 | 1/1972 | Witt . |
| 3,748,220 | 7/1973 | Gard . |
| 3,784,649 | 1/1974 | Buckman . |
| 3,992,249 | 11/1976 | Farley . |
| 4,166,894 | 9/1979 | Schaper . |
| 4,250,269 | 2/1981 | Buckman et al. . |
| 4,253,912 | 3/1981 | Becker et al. . |

FOREIGN PATENT DOCUMENTS

| | | | |
|---|---|---|---|
| 59-223392 | 12/1984 | Japan | 162/55 |
| 61-55294 | 3/1986 | Japan . | |
| 2160538A | 12/1985 | United Kingdom . | |

OTHER PUBLICATIONS

Gard, "Some Practical Aspects of Chelatin in Papermaking", *TAPPI*, vol. 47, No. 1, Jan. 1964, pp. 198A–210A.

Hassler, "Pitch Deposition in Papermaking and the Function of Pitch-Control Agents", *TAPPI Journal*.

May et al., "A Versatile New Polymer for Use in the Manufacture of Paper and Paperboard", Appita, vol. 32, No. 6, May, 1979, pp. 466–463.

Casey, Pulp and Paper, vol. 11, 2nd Ed., pp. 1096–1097, Chemical Abstracts, vol. 105, p. 107, entry 105:99426q.

Louche et al., "The Role of Special Electrolytes for the Solution of Operating Problems in Paper and Board Production".

Goosens et al., "Flocculation of Microcystalline Cellulose Suspensions with Cationic Polymers: Effect of Agitation", TAPPI, vol. 59, No. 2, Feb. '76, pp. 89–94.

*Primary Examiner*—Steve Alvo

*Attorney, Agent, or Firm*—James P. Barr

[57] ABSTRACT

A method of controlling pitch in an aqueous system involved in paper making as described which comprises adding a cationically modified tannin to the system.

16 Claims, No Drawings

METHOD OF CONTROLLING PITCH USING A CATIONICALLY MODIFIED TANNIN

This invention relates to the control of pitch in the manufacture of paper.

It is well known that "pitch" can accumulate in paper making causing significant problems. "Pitch" is the term used to describe the sticky materials which appear in paper making; these can be derived from the wood from which the paper is made. However, nowadays when more recycled paper is used, "pitch" is now used also as a general term for anionic debris for example the ink or adhesive present in recycled paper. The pitch can accumulate at various points in the system. For example it can block the felt causing it to pick holes in the paper and thus hinder drainage of the paper web. In addition, it can adhere to the wires or drying cylinders.

Many materials have been used in attempt to eliminate this problem. Such materials include inorganic treatments such as talc and anionic dispersants. However, conventional dispersants can be ineffective in a closed system as there can be a build-up of "pitch". In such systems the pitch particles have to be removed from the water system in a controlled way without being allowed to accumulate on the felt or rolls or, for example, the pipe work used in the paper making machinery.

It has now been found, according to the present invention, that cationically modified tannins are effective for this purpose. In effect, the addition of such tannins is believed to cause the pitch particles to deposit on the paper web in such a finely divided form that they are neither noticeable nor cause problems regarding machine runnability. Accordingly, the present invention provides a method for the control of pitch in an aqueous systems used in paper making which comprises adding to the system a cationically modified tannin.

In general, the cationically modified tannins which can be used in the present invention are derived from tannin, an amino compound which contains, or is capable of generating, a primary amino group, and an aldehyde or a compound which can generate an aldehydic group.

The tannin component can be obtained from the various wood and vegetation materials found throughout the world. Tannins are a large group of water-soluble, complex organic compounds. Almost every tree or shrub that grows contains some tannins in the leaves, twigs, barks, wood or fruit. Examples of barks are wattle, mangrove, oak, eucalyptus, hemlock, pine, larch and willow. Examples of woods are the quebracho, chestnut, oak and urunday. Examples of fruits are myrobalans, valonia, divi-divi, tara, and algarrobilla. Examples of leaves are sumac and gambier and examples of roots are canaigre and palmetto. Among the preferred materials is the quebracho wood. A spray-dried quebracho powder is commercially available.

These natural tannins can be categorized into the traditional "hydrolyzable" tannins and "condensed tannins" as disclosed by A. Pizzi in "Condensed Tannins for Adhesives", *Ind. Eng. Chem. Prod. Res. Dev.* 1982, 21, 359–369. Condensed tannin extracts are those manufactured from the bark of the black wattle tree (or mimosa tannin of commerce), from the wood of the quebracho tree (Spanish: Quebra hacha, axe-breaker,) from the bark of the hemlock tree, and from the bark of several commonly used pine species The preparation of wattle and quebracho extracts is a well established industrial practice and such extracts are freely available in considerable amounts.

Condensed tannin extracts, such as wattle and quebracho, are composed of approximately 70% polyphenolic tannins, 20% to 25% nontannins, mainly simple sugars and polymeric carbohydrates (hydrocolloid gums), the latter of which usually constitute 3% to 6% of the extract and heavily contribute to extract viscosity, while the balance is accounted for by a low percentage of moisture Although the exact structure is not known, it is believed that the main polyphenolic pattern in quebracho tannins is represented by flavonoid analogues based on resorcinol A and pyrogallol B rings as shown in Formula 1 below:

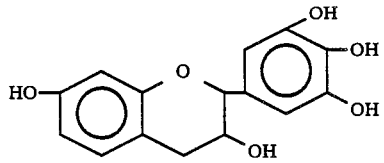

I

The second component of the reaction is an aldehyde. A preferred material is formaldehyde which can be used in the form of a 37% active formaldehyde solution. This is also commercially available as formalin which is an aqueous solution of 37% formaldehyde which has been stabilized with from 6–15% methanol. Other commercial grades of formaldehyde and its polymers could be used. Such commercial grades include 44, 45 and 50% low-methanol formaldehyde, solutions of formaldehyde in methyl, propyl, n-butyl, and isobutyl alcohol, paraformaldehyde and trioxane.

Other aldehyde-containing reactants which can be used include organic chemical compounds which contain at least one aldehyde group therein, for example acetaldehyde, propionaldehyde, glycolaldehyde, glyoxylic acid and polyaldehydes (i.e., organic compounds having more than one aldehyde group in the compound) such as glyoxal and paraformaldehyde. Other suitable reactants include aldehyde-generating agents i.e. known organic compounds capable of forming an aldehyde group in situ, such as melamine-formaldehyde monomeric products such as tri and hexa(methylol) melamine and the tri and hexa ($C_1$–$C_3$ alkoxymethyl)-melamine. Such materials can be formed by known conventional methods. The alkyl blocked derivatives are commercially available, are stable to self polymerization and are, therefore, preferred.

The third component for the reaction product is an amino compound such as ammonia as, for example, ammonium chloride or a primary or secondary amine or amide compound, such as monoethanolamine, methylamine and ethylamine.

The product obtained is believed to consist of a polymeric substance which has been modified by a "Mannich" reaction. In the Mannich reaction an aldehyde is condensed with an amino compound and an active hydrogen supplied by the polyphenolic tannin Although the structure of tannin is not completely known, it is believed the reaction product can be approximated by the following recurring structure:

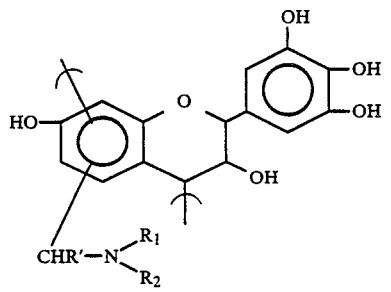

where

CHR' is the remainder of the aldehyde compound of formula CHOR' after the carbonyl oxygen has left and $R_1$ and $R_2$ are independently hydrogen or other organic moieties that were part of the original amino compound.

According to this theory the molecular weight of a repeating tannin unit is assumed to be approximately 300. The molar ratio of the primary amine to the tannin repeating unit is suitably from 1.5:1 to 3.0:1.

Particularly preferred materials used in the present invention include amino methylated crosslinked tannins which can be obtained using formaldehyde and ammonium chloride and, typically, quebracho tannin powder. These may be formed as a salt e.g. acetate, formate or hydrochloride or quaternised.

Cationically modified tannins for use in the present invention can be prepared as described in, for example, British Application No. 8501734 (published as UK Patent Application No. GB 2 152 945A and patented as UK Patent GB 2 152 945B).

The cationically modified tannins generally have a relatively low molecular weight, generally not greater than 100,000. Preferred materials have a molecular weight from 20,000 to 30,000.

The cationically modified tannin is generally added to the aqueous system with the furnish containing the paper pulp but it is possible to add it at different points in the system depending on the precise nature of the problem.

The pulp will generally be present in an amount from 0.5 to 10%, more usually 0.5 to 5% by weight based on the weight of the water.

The amount of cationic tannin required will, of course, depend to some extent on the nature of the wood or other material used to prepare the paper pulp. Also some tannin once added will tend to recirculate in the system thus requiring a lower addition rate. In general, however, from 0.025 to 10 kg of tannin is required per tonne of dry paper fibre. Preferably, the amount is 0.5 to 3 kg per tonne. However, in cases where the tannin is required to neutralize anionic dissolved materials, even higher amounts may be desirable, for example up to 50,000 grams, and especially from 1,500 to 15,000 grams, per tonne fibre depending on the process by which the fibres are produced (see, for example, Progr. Colloid & Polymer Sci. 65, 251–264 (1978) for a discussion of the amounts of anionic material likely to be present). Fibres produced by a mechanical process generally require a higher addition than fibre prepared by a chemical process. It is, of course, also possible to only partly neutralize the total amount of dissolved anionic materials. In such cases amounts from as little as, say, 10 grams per tonne of paper may be effective.

Sometimes it can be preferred to spray the reaction product used in this invention onto a particular part of the pulp-or paper-making machinery such as the wire or press felts. In such cases, the tannin is preferably prediluted with water, generally to a concentration below 10% by weight and preferably 1 to 5% by weight.

In some instances it will be convenient to add the tannin together with a biocide and/or other paper-making additives examples ©f suitable biocides include those in the following classes:

(i) a substituted 5 or 6 membered ring heterocyclic compound in which the hetero atom or atoms are one or more of nitrogen, oxygen or sulphur and the substituent is an alkyl group, a keto group or a hydroxyl group or a halogen atom, such compounds include isothiazolones and in particular, those having the formula:

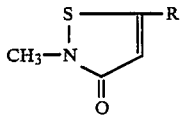

wherein R represents hydrogen or chlorine. A blend of these two isothiazolones is commercially available, the weight ratio of the chlorosubstituted compound to the unsubstituted compound being about 2.66:1;

(ii) a phenol or chlorinated phenol such as pentachlorophenol;

(iii) an amine or amide including 2,2-dibromo-3-nitrilopropionamide;

(iv) an organic cyanide or thiocyanate, particularly methylene bis(thiocyanates);

(v) a sulphone including halosulphones, particularly hexachlorodimethylsulphone;

(vi) a straight chain aliphatic aldehyde, particularly glutaraldehyde;

(vii) a triazine, particularly thio and/or aminosubstituted alkyl triazines;

(viii) bis bromo acetoxy butene; and (ix) a dithiocarbamate, especially the monomethyl, dimethyl, monoethyl and diethyl derivatives, typically in the form of sodium salts.

Suitable paper making additives include starch, for example potato or corn starch, titanium dioxide, a defoamer such as a fatty acid alcohol, a size, for example a rosin size based on abietic acid, a neutral size based on alkyl ketene dimer or a succinic acid anhydride based size and a wet strength resin such as, if neutral, an epichlorohydrin polyamide or, if acid, a melamine- or urea-formaldehyde resin.

The precise nature of the pH of the system is unimportant since the effectiveness of the cationic tannin is substantially unaffected by changes in pH.

The following Example further illustrates the present invention.

EXAMPLE

To a furnish containing 0.8% pitch free pulp was added a synthetic pitch to give between $1 \times 10^7$ pitch particles per ml as measured in a haemocytometer cell on an optical microscope. The synthetic pitch used had the following composition by weight:

20% Oleic acid

5% Potassium hydroxide

75% Ethanol

For the purposes of the test, the pH of the furnish was adjusted to either 5.0 or 6.0 with hydrochloric acid. The furnish was then divided into various portions and to each was added a different concentration of cationic modified tannin (an amino-methylated crosslinked tannin) as an aqueous solution containing about 27.5% by weight. The various furnishes were then placed in a Dynamic Paper Chemistry Jar Mark III supplied by the Paper Chemistry Laboratory Limited of New York U.S.A. The filtrate of white water from the jar was then collected for each individual addition of cationic modified tannin and the pitch content measured in a haemocytometer cell on an optical microscope.

| Concentration of Cationic Modified Tannin | % Pitch Redn. at pH 5.0 | % Pitch Redn. at pH 6.0 |
|---|---|---|
| 0 kg/tonne fibre (dry) | 0 | 0 |
| 1.75 kg/tonne fibre | 65% | 24% |
| 3.50 kg/tonne fibre | 89% | 84% |
| 7.0 kg/tonne fibre | — | 100% |
| 8.75 kg/tonne fibre | 99% | — |
| 17.5 kg/tonne fibre | 100% | 100% |

These results indicate the addition of cationic modified tannin to the furnish, results in a significant reduction in pitch particles in the filtrate or white water. This proves the cationic modified tannin to be a pitch control aid capable of preventing accumulation of pitch in the paper machine system.

We claim:

1. A method of controlling pitch in an aqueous system involved in paper making which uses paper fiber which comprises adding to the system a cationically modified tannin which is derived from (1) a tannin, (2) an amino compound which contains or is capable of generating a primary amino group, and (3) an aldehyde or a compound which is capable of generating an aldehyde group; said cationically modified tannin being added in ana mount effective to control the accumulation of pitch in the paper machine system.

2. A method according to claim 1 in which the cationically modified tannin is added to the aqueous system with the furnish.

3. A method according to claim 1 in which the cationically modified tannin is added in an amount from 0.025 to 10 kg per tonne of dry paper fibre.

4. A method according to claim 3 in which the cationically modified tannin is added in an amount from 0.5 to 3 kg per tonne of dry paper fibre.

5. A method according to claim 1 in which the cationically modified tannin is derived from said tannin, said amino compound and an aldehyde.

6. A method according to claim 5 in which the amino compound is ammonium chloride.

7. A method according to claim 1 in which the cationically modified tannin has a molecular weight not exceeding 100,000.

8. A method according to claim 7 in which the cationically modified tannin has a molecular weight from 20,000 to 30,000.

9. A method according to claim 1 in which the cationically modified tannin is added together with a paper additive.

10. A method according to claim 1 in which an amino-methylated crosslinked tannin is added to the furnish as an aqueous solution containing about 27% by weight in an amount (dry basis) from about 0.5 to 3 kg per tonne of paper fibre.

11. A method according to claim 5 wherein said aldehyde is formaldehyde.

12. A method according to claim 5 wherein said tannin is a quebracho tannin.

13. A method according to claim 12 wherein said amino compound is ammonium chloride, said aldehyde is formaldehyde; wherein said cationically modified tannin is an amino-methylated crosslinked tannin; and wherein said cationically modified tannis is added as an aqueous solution.

14. A method according to claim 13 wherein between about 0.025 kg and about 10 kg of said cationically modified tannin is added to the system per tonne of dry paper fibre.

15. A method according to claim 1 wherein said amino compound is ammonium chloride.

16. A method according to claim 9 wherein the paper additive comprises a biocide.

* * * * *